US006708437B2

(12) United States Patent
Murello

(10) Patent No.: US 6,708,437 B2
(45) Date of Patent: Mar. 23, 2004

(54) APPARATUS FOR LOADING A CARTRIDGE INTO A CARTRIDGE CHAMBER

(75) Inventor: Johannes Murello, Deisslingen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 09/941,266

(22) Filed: Aug. 28, 2001

(65) Prior Publication Data

US 2002/0050087 A1 May 2, 2002

Related U.S. Application Data

(63) Continuation of application No. PCT/EP00/01536, filed on Feb. 24, 2000.

(30) Foreign Application Priority Data

Feb. 24, 1999 (DE) ..... 199 07 967

(51) Int. Cl.[7] ..... F41A 3/00
(52) U.S. Cl. ..... 42/16; 89/180; 89/188
(58) Field of Search ..... 42/16; 89/180, 89/184, 189

(56) References Cited

U.S. PATENT DOCUMENTS

| | | | | | |
|---|---|---|---|---|---|
| 3,225,657 | A | * | 12/1965 | Kruzell | 42/69.01 |
| 3,641,692 | A | * | 2/1972 | Wells | 42/16 |
| 3,742,638 | A | | 7/1973 | Archer | 42/25 |
| 4,282,670 | A | * | 8/1981 | Junker | 102/513 |
| 4,655,118 | A | * | 4/1987 | Bruderer et al. | 89/185 |
| 4,730,537 | A | * | 3/1988 | Matzagg et al. | 42/70.08 |
| 5,499,569 | A | | 3/1996 | Schuetz | 89/197 |
| 5,520,019 | A | * | 5/1996 | Schuetz | 42/49.02 |
| 5,920,028 | A | * | 7/1999 | Guhring et al. | 42/16 |
| 6,101,919 | A | * | 8/2000 | Murello | 42/16 |
| 6,182,389 | B1 | * | 2/2001 | Lewis | 42/16 |
| 6,279,258 | B1 | * | 8/2001 | Hashman | 42/16 |

FOREIGN PATENT DOCUMENTS

| | | | | |
|---|---|---|---|---|
| DE | 2527666 C1 | * | 10/1985 | F41D/7/04 |
| EP | 0 803 698 A2 | | 2/1997 | |
| FR | 894.054 | | 12/1944 | |

OTHER PUBLICATIONS

*International Search Report*, correspponding to Interntional Patent Application Serial No. PCT/EP00/01536, European Patent Office, dated May 19, 2000, 4 pages.

*International Preliminary Examination Report*, corresponding to International Patent Application Serial No. PCT/EP00/01536, International Bureau of WIPO, dated Oct. 03, 2001, 6 pages.

* cited by examiner

*Primary Examiner*—Michael J. Carone
*Assistant Examiner*—Troy Chambers
(74) *Attorney, Agent, or Firm*—Grossman & Flight, LLC

(57) ABSTRACT

An apparatus for loading a cartridge into a cartridge chamber of a firearm is provided. The apparatus includes a barrel, and a bolt assembly mounted for movement from a rear position to a forward position to advance a cartridge into the cartridge chamber. The bolt assembly includes a center axis which is not in coaxial alignment with the center axis of the barrel when the bolt assembly is in the rear position. The bolt assembly further includes a bolt head defining a percussion recess. The percussion recess is dimensioned to receive a proximal end of the cartridge with clearance to permit transverse movement of the proximal end of the cartridge relative to the percussion base. The firearm also includes a locking piece adjacent the cartridge chamber for centering the bolt head as the bolt assembly moves from the rear position toward the forward position such that the center axis of the bolt assembly is substantially coaxially aligned with the center axis of the barrel. The center axis of the cartridge becomes substantially coaxially aligned with the center axis of the barrel after engagement of the bolt head and the cartridge but before the center axis of the bolt assembly becomes substantially coaxially aligned with the center axis of the barrel.

13 Claims, 4 Drawing Sheets

APPARATUS FOR LOADING A CARTRIDGE INTO A CARTRIDGE CHAMBER

RELATED APPLICATION

This patent claims priority under 35 U.S.C. § 120 from International Application No. PCT/EP00/01 536, which was filed on Feb. 24, 2000.

FIELD OF THE INVENTION

The invention relates generally to firearms, and, more particularly, to a device for loading a cartridge into a cartridge chamber of a barrel of an automatic small arm.

BACKGROUND OF THE INVENTION

During cartridge loading, entrainment of a cartridge occurs via a bolt head on the front end of the bolt assembly of the weapon. A recess that forms a recessed percussion base can be situated on this front side of the bolt head. During reloading of the weapon, the uppermost cartridge of a magazine, the next cartridge of a horizontal belt feed, or the like, is brought into a feed position in front of the bolt head. A recoil spring pushes the bolt assembly and the bolt head forward. The cartridge is then moved forward together with the bolt assembly. During this forward movement, the cartridge is raised so that the rear end of the cartridge casing finally reaches the recess of the bolt head, if present. During subsequent forward movement, the cartridge is pushed into the cartridge chamber of the barrel. Because of the narrow tolerances between the engagement of the cartridge and the cartridge chamber, the cartridge is centered with respect to a center axis of the barrel or bore of the barrel. At the conclusion of the forward movement, the bolt assembly is connected to the barrel by means of a locking piece fastened on the barrel. This connection can be affected, for example, by rotation of the bolt head. The weapon is then in a loaded state.

The bolt assembly must then be centered with reference to the cartridge and the barrel. The centering of the cartridge relative to the bolt head is achieved by seating the rear end of the cartridge casing in the recessed percussion base of the bolt head. Substantial tolerances can be present between the bolt assembly and a housing that guides it to permit trouble-free functioning of the weapon even when heavily soiled. However, the tolerances between the engagement of the rear end of the casing and the percussion base of the bolt head must be close. The periphery of the percussion base must be countersunk, in order to facilitate entry of the cartridge into the percussion base.

A firearm, in which the barrel has a shoulder with a conical input opening behind the cartridge chamber, is described in U.S. Pat. No. 3,641,692. In that patent, the bolt assembly is introduced into the conical input opening during loading of the weapon. Substantial tolerances are present between the introduced bolt assembly and the shoulder. Centering of the bolt assembly with reference to the center axis of the barrel therefore occurs in the usual manner, namely, by the seat of the cartridge casing on the front end of the bolt assembly.

It is proposed in the small arm described in U.S. Pat. No. 3,225,657 to configure the outer surfaces of the front end of the bolt assembly to be conical. These outer surfaces come into contact with the also conically-shaped inside surfaces of a part coupled to the rear end of the barrel when the bolt assembly enters its forwardmost position to complete loading of the weapon. This engagement seals the barrel to the rear.

A cylindrical bolt assembly with extremely limited tolerances is known from U.S. Pat. No. 3,742,638.

U.S. Pat. No. 5,499,569 and U.S. Pat. No. 3,641,692 each includes an inner cone directly connected to the cartridge chamber to the rear which is engaged by an outer cone on the front side of the bolt assembly. In each case, however, the purpose of this cone is to prevent gas escape from the rear of the barrel. Centering is neither sought nor disclosed in these documents.

SUMMARY OF THE INVENTION

In accordance with an aspect of the invention, an apparatus is provided for use in a firearm. The apparatus includes a barrel having a center axis; a cartridge chamber; and a bolt assembly that can be displaced in the longitudinal direction of the weapon from a rearward position to a forward position to advance the cartridge into the cartridge chamber. The apparatus also includes a centering element rigidly connected to the barrel for centering the bolt assembly before the cartridge is completely introduced into the cartridge chamber as the bolt assembly moves from the rearward position toward the forward position. A center axis of the bolt assembly is not coaxial with the center axis of the barrel when the bolt assembly is in the rearward position. The center axis of the bolt assembly is coaxially aligned with the center axis of the barrel after centering by the centering element. The centering element comprises a cavity including recesses with outer surfaces which taper conically from a rear of the cavity to a front of the cavity.

In accordance with another aspect of the invention a firearm is provided which includes a barrel having a center axis; a cartridge chamber; and a bolt assembly mounted for movement from a rear position to a forward position to advance a cartridge into the cartridge chamber. The bolt assembly includes a center axis which is not in coaxial alignment with the center axis of the barrel when the bolt assembly is in the rear position. The bolt assembly further includes a bolt head defining a percussion recess. The percussion recess is dimensioned to receive a proximal end of the cartridge with clearance to permit transverse movement of the proximal end of the cartridge relative to the percussion base. The firearm also includes a locking piece adjacent the cartridge chamber for centering the bolt head as the bolt assembly moves from the rear position toward the forward position such that the center axis of the bolt assembly is substantially coaxially aligned with the center axis of the barrel. The center axis of the cartridge is not in coaxial alignment with the center axis of the barrel when the bolt head engages the cartridge. The center axis of the cartridge becomes substantially coaxially aligned with the center axis of the barrel after engagement of the bolt head and the cartridge but before the center axis of the bolt assembly becomes substantially coaxially aligned with the center axis of the barrel.

In accordance with another aspect of the invention, a method is provided for loading a cartridge into a cartridge chamber of a firearm. The method comprising the steps of: (A) advancing a bolt assembly in a longitudinal direction of the weapon; (B) engaging the cartridge with a bolt head of the bolt assembly at a first time when a center axis of the cartridge is not coaxially aligned with a center axis of the cartridge chamber and while a center axis of the bolt assembly is not coaxially aligned with the center axis of the cartridge chamber; (C) at a second time after the first time, centering the cartridge such that the center axis of the cartridge is in substantial coaxial alignment with the center axis of the cartridge chamber; and (D) at a third time after the second time, centering the bolt assembly such that the center axis of the bolt assembly is in substantial coaxial alignment with the center axis of the cartridge chamber.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
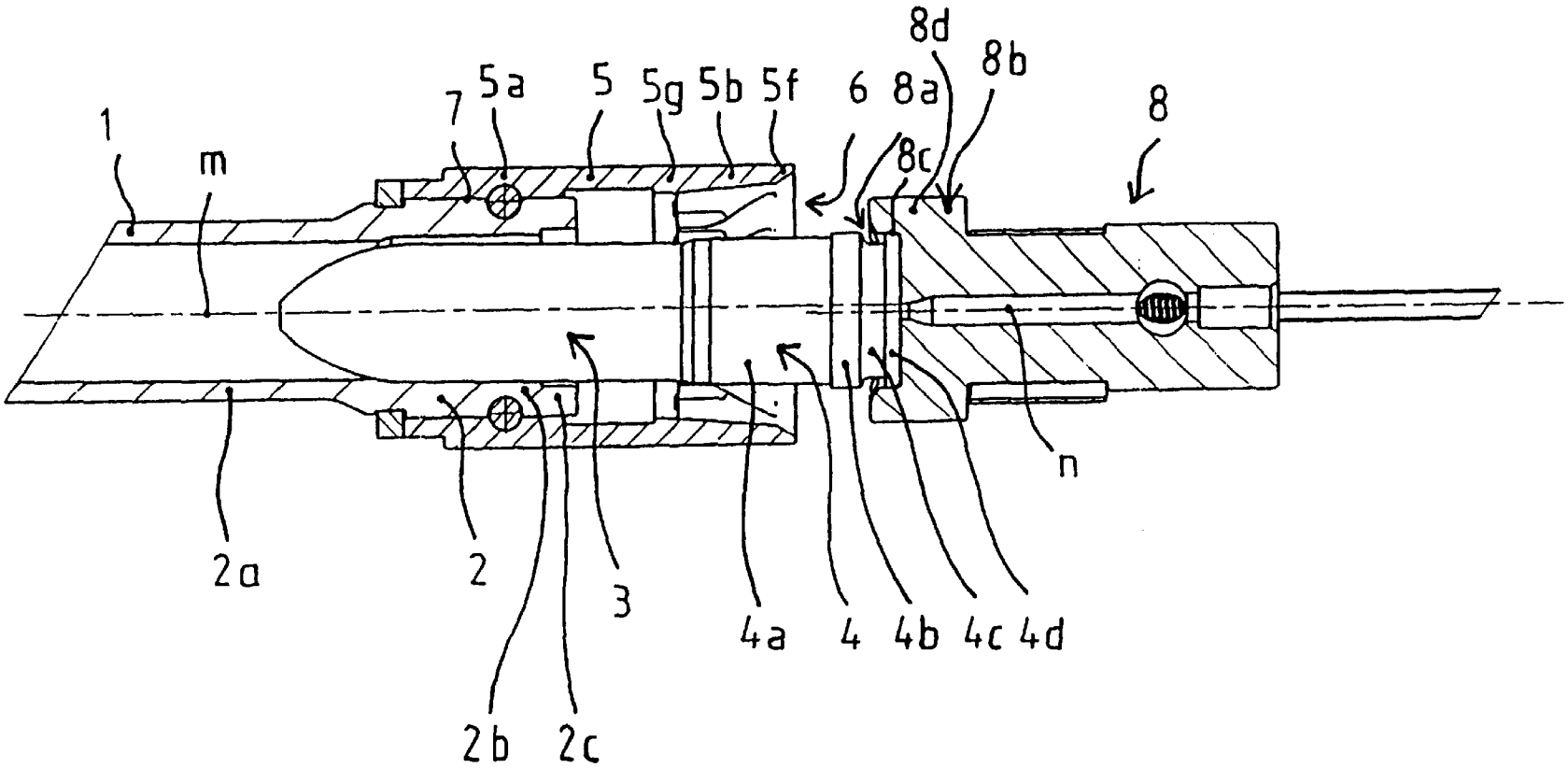
FIG. 1 is a schematic illustration of a section of an exemplary small arm in a first position of an exemplary bolt assembly constructed in accordance with the teachings of the instant invention.

A barrel 1 of an automatic firearm is shown in FIG. 1. The illustrated barrel is made of steel or titanium. A cartridge chamber 2 which is dimensional to receive a cartridge 3 (such as a belt cartridge) having a cartridge casing 4 is integral with the rear of the barrel 1 end section (on the right in FIG. 1). The inside diameter of a front cartridge chamber section 2*a* (lying to the left in FIG. 1), is identical to the inside diameter of the barrel 1. A central cartridge chamber section 2*b* (lying to the right of the front cartridge chamber section 2*a* in FIG. 1), has a larger inside diameter than the front cartridge chamber section 2*a*. A rear cartridge chamber section 2*c* (lying to the right of the center cartridge chamber section 2*b* in FIG. 1), has a greater inside diameter than the center cartridge chamber section 2*b*. The inside diameters of the barrel 1 and the front cartridge chamber section 2*a* correspond to the outside diameter of a projectile on the front end of the cartridge 3. The outside diameter of a front section 4*a* of the cartridge casing 4 (lying to the left in FIG. 1), also corresponds to the inside diameter of the center cartridge chamber section 2*b*. The outside diameter of a center cartridge casing section 4*b* (lying to the right of the front cartridge casing section 4*a* in FIG. 1), corresponds to the inside diameter of the rear cartridge chamber section 2*c*.

A locking piece 5 is fastened to the cartridge chamber 2. The locking piece 5 defines a continuous cavity 6. An inside wall of a front section 5*a* of the locking piece 5 (lying to the left in FIG. 1), lies on an outside wall 7 of the center and rear cartridge chamber sections 2*b*, 2*c* and is connected to those sections 2*b*, 2*c*.

A rear cartridge casing section (lying to the right in FIG. 1), has, on its rear end, a projection 4*d* with greater outside diameter than the adjacent rear cartridge casing section 4*c*. (As an alternative, the outside diameter of the rear cartridge casing section 4*c* can also be equally large (not shown)). The rear cartridge casing section 4*c* with projection 4*d* is accommodated in a hollow cylindrical recess 8*a* in a front end of a bolt head 8*b* of a bolt assembly 8 (lying to the left in FIG. 1). The inside diameter of recess 8*a* is greater than the diameter of projection 4*d* of the rear cartridge casing section 4*c*. A relatively large clearance is therefore present between an annular inside surface 8*c* of recess 8*a* and an annular outside surface of projection 4*d*.

Figure 4:
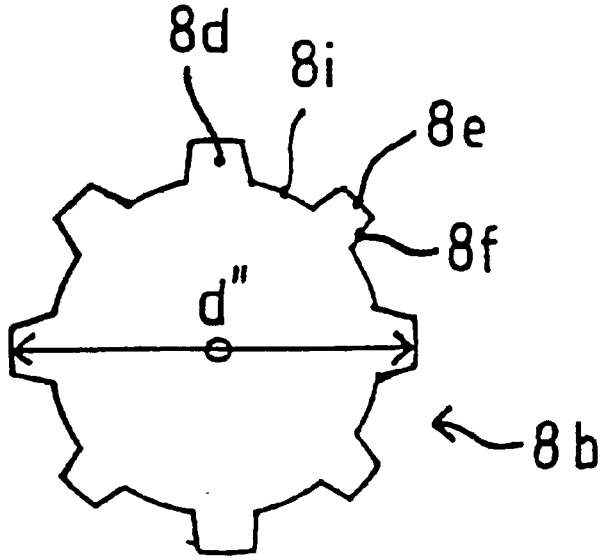
FIG. 4 is a cross-sectional view of the bolt head of the automatic firearm depicted in FIGS. 1, 2 and 3.

As shown in FIG. 4, the bolt assembly 8 has shoulders 8*d* on the bolt head 8*b*. These shoulders 8*d* run in the longitudinal direction and extend outward from the bolt head 8*b* at equal angular sections. Each of the shoulders 8*d* has a flat outer surface 8*e* and flat side surface 8*f* that extend roughly in a horizontal direction (referred to FIG. 1).

Figure 5:
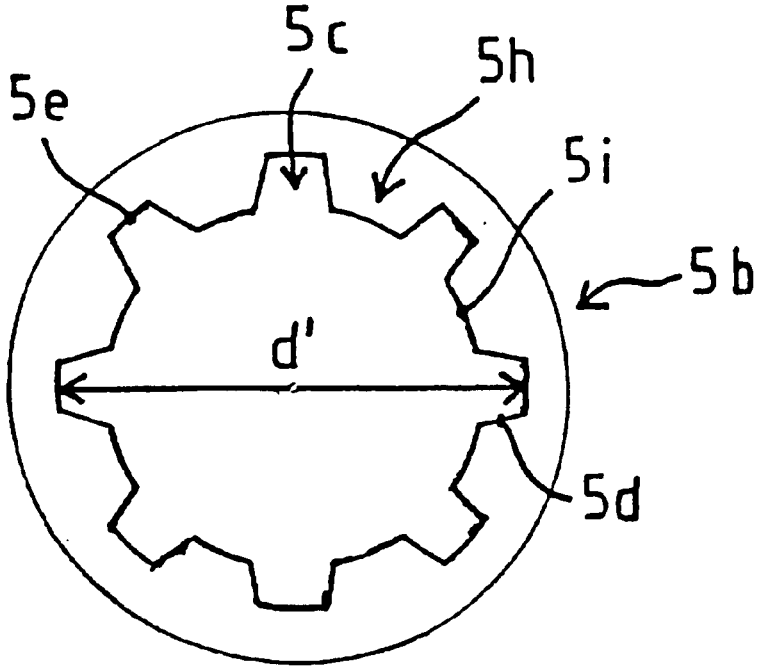
FIG. 5 is a cross-sectional view of the rear section of the locking piece of the firearm shown in FIGS. 1–3.

Complementary to the shoulders 8*d* of bolt assembly 8, a rear section 5*b* (lying to the right in FIG. 1 of the locking piece 5) has recesses 5*c* as shown in FIG. 5. These recesses 5*c* are arranged so that a guide rail 5*h* is produced between every adjacent pair of recesses 5*c*. The shoulders 8*d* of the bolt head 8 then correspond in cross sectional shape to the recesses 5*c* of the locking piece 5. As shown in FIG. 1, the recesses 5*c* and the guide rails 5*h* run forward in the longitudinal direction from a front end of a rear part 5*f* of the rear section 5*b* of the locking piece 5 to a rear end of a front part 5*g* of the rear section 5*b* of the locking piece 5. The front part 5*g* of the rear section 5*b* of locking piece 5 has the shape of a hollow cylinder.

As shown in FIG. 5, the recesses 5*c* of the rear section 5*b* of the locking piece 5 extend into the interior of the rear section 5*b* of the locking piece 5 in the same angular sections as the shoulders 8*d*. Each of the recesses 5*c* has a flat inside surface 5*e* and flat side surfaces 5*d*. As shown in FIG. 1, the opposite inside surfaces 5*e* of recesses 5*c* taper conically forward and the opposite outside surfaces 5*i* of guide rails 5*h* run parallel. (In an alternative approach, the opposite outside surfaces 5*i* of guide rails 5*h* taper conically forward. The outer surfaces 5*i* of guide rails 5*h* then grade flatly into the inside surface of the rear part 5*f* of the locking piece, and the guide rails 5*h* are triangular in longitudinal section.)

The inside surface of the rear part 5*f* of the rear section 5*b* of the locking piece 5 has the shape of a cone that tapers from the rear to the front. The tapering is stronger than in the inside surfaces 5*e* of recesses 5*c* and, in the aforementioned alternative approach, stronger than in the outside surface 5*i* of guide rails 5*h*.

As shown in FIG. 5, the distance d' between two opposite inside surfaces 5*e* of recesses 5*c* of the rear locking piece section 5*b* becomes smaller from the rear to the front. (The same applies in the aforementioned alternative approach for the distance between two opposite outside surfaces 5*i* of guide rails 5*h*.) The distance d' between two opposite inside surfaces 5*e* of recesses 5*c* is minimal on a front end of the recesses 5*c* and, at that front end, corresponds to the distance d", (see FIG. 4), between two opposite outside surfaces 8*e* of the bolt head 8 and to the inside diameter of an inside wall of the adjacent hollow cylindrical front part 5*g* of the rear section 5*b* of the locking piece 5. (Similarly, in the aforementioned alternative approach, the distance between two opposite outside surfaces 5*i* of the guide rails 5*h* is minimal on a front end of the guide rails 5*h*, and, at that front end, correspond to the distance between two opposite inside surface 8*i* between two shoulders 8*d* of the bolt head 8.)

When the firearm is being loaded, the bolt assembly 8 is initially moved forward in the direction of the position depicted in FIG. 1 by the recoil spring (not shown). The bolt assembly 8 then pushes the cartridge 3 forward. The cartridge 3 is lifted as it is moved forward. In the illustrated device, the rear cartridge casing section 4*c* of cartridge 3 is introduced into the recess 8*a* of the bolt head 8*b* when the cartridge is lifted. On further forward movement of the cartridge 3, an outer wall of the projectile comes into contact with an inside wall of the rear cartridge chamber section 2*c*, and then an inside wall of the middle cartridge chamber section 2*b* (see FIG. 1).

A center axis n of the bolt assembly 8 or recess 8*a* of the bolt head 8*b* lies skewed or parallel to (but offset from) a center axis m of the barrel 1. The bolt assembly center axis n is, therefore, still not centered with reference to the barrel center axis m. The same applies for a center axis of the cartridge (not shown), namely, it is not centered with respect to the barrel center axis m.

Figure 2:
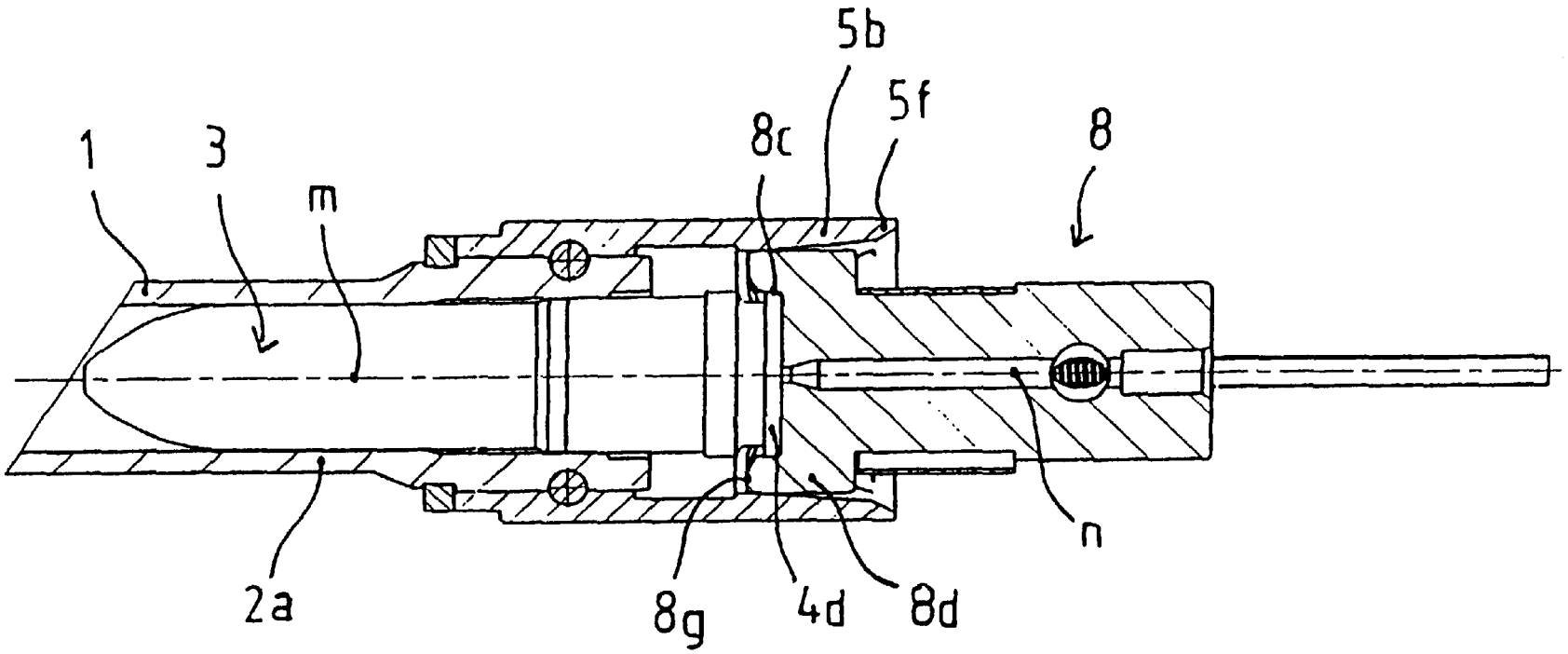
FIG. 2 is a view similar to FIG. 1 but showing the bolt assembly and cartridge in a second position.

If the bolt assembly 8 and the cartridge 3 are moved farther forward in the direction of the position depicted in FIG. 2, the outer wall of the projectile of cartridge 3 comes in contact with an inside wall of the front cartridge chamber section 2*a*. Since, as explained, the inside diameter of barrel 1 and the front cartridge chamber section 2*a* are equal to the outside diameter of the projectile of the cartridge 3, the center axis (not shown) of the cartridge 3 becomes centered on the barrel center axis m by virtue of this movement. On the other hand, the center axis n of bolt assembly 8 is initially still not centered with the barrel center axis m. To enable this centering of the cartridge 3 while the bolt head 8*b* remains off-center, a clearance is present between the annular inside surface 8*c* of the recess 8*a* and the outside surface of the projection 4*d* of cartridge 3, as explained above.

On further forward movement of the bolt assembly 8, the front cartridge casing section 4*a* reaches the center cartridge chamber section 2*b*. A front edge between the outer surface 8*e* of the shoulder 8*d* (lying on the bottom in FIG. 2) of the bolt assembly 8 and its front surface 8*g* initially touch the inside surface of the rear part 5*f* and then the inside surface 5*e* of the recess 5*c* (also lying on the bottom in FIG. 2) of the rear section 5*b* of the locking piece 5. Because of the conical tapering of the inside surface of the rear part 5*f* and the inside surface 5*e* of recess 5*c*, the bolt assembly 8 is raised during its further forward movement until finally, in the position depicted in FIG. 2, the center axis n of the bolt assembly 8 is centered on the barrel center axis m. The edge of the bolt assembly 8 has then reached the front part 5*g* of the rear locking piece section 5*b*. As mentioned above, at this position the distance d' between two opposite outside surfaces 5*e* of the recesses 5*c* of locking piece 5 corresponds to the distance d" between the two opposite outside surfaces 8*e* of the shoulders 8*d* of bolt head 8.

Figure 3:
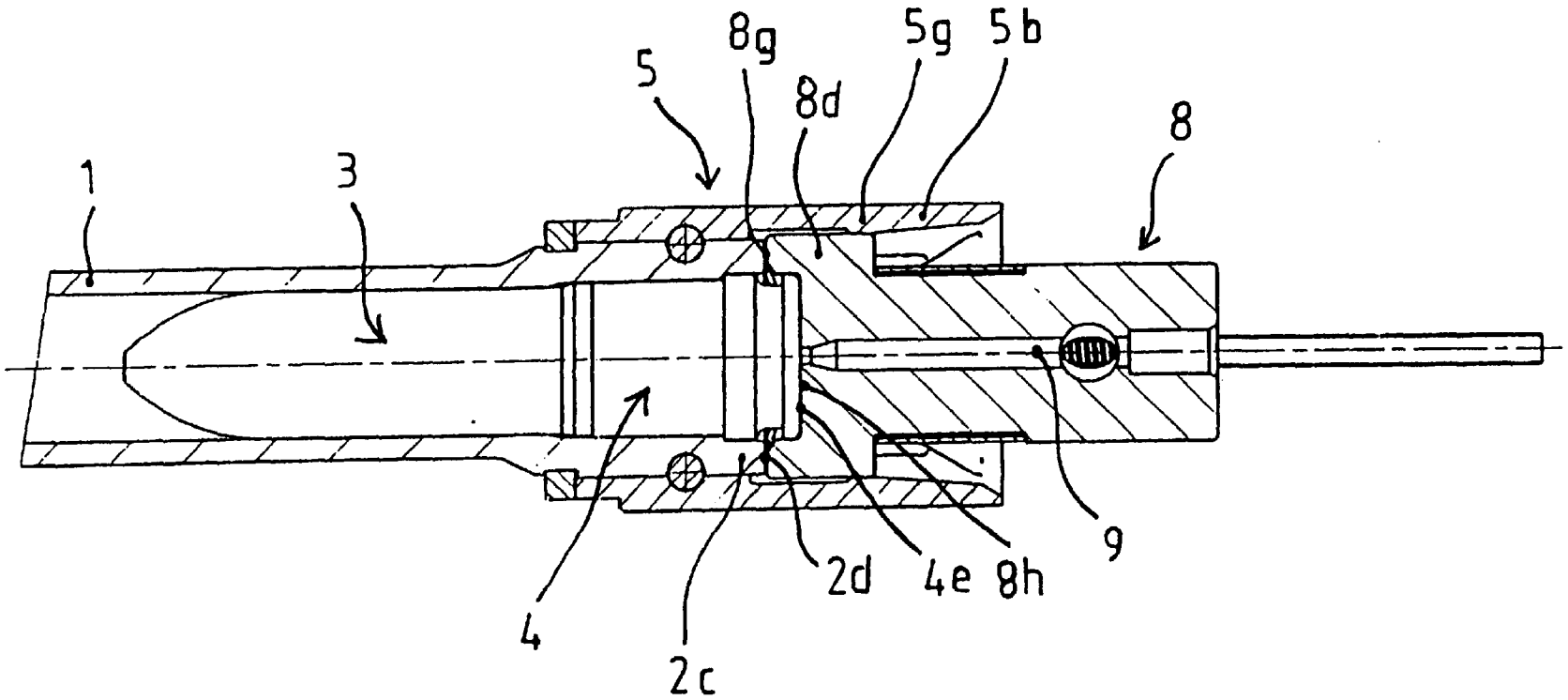
FIG. 3 is a view similar to FIGS. 1 and 2 but showing the bolt assembly and cartridge in a third position.

If the bolt assembly 8 and the cartridge 3 are moved farther forward in the direction of the position shown in FIG. 3, the outer surfaces 8*e* of the shoulders 8*d* of the bolt assembly 8 touch the inside surface of the adjacent hollow cylindrical front part 5*g* of the rear section 5*b* of the locking piece 5. The bolt assembly 8 is then guided farther forward in the hollow cylindrical front part 5*g* along the bolt assembly center axis n with relatively limited clearance.

Finally, as shown in FIG. 3, the cartridge casing 4 reaches the cartridge chamber 2 and the front surface 8*g* of the bolt assembly 8 lies immediately in front of a rear side surface 2*d* of the rear cartridge chamber section 2*c*. The shoulders 8*d* of the bolt head 8*b* now lie in front of the guide rails 5*h* of the locking piece 5. In this position, the bolt head 8*b* can be rotated in the usual manner and, on this account, the bolt head 8*b* can be fixed with the locking piece 5 and, thus, with the barrel 1 against displacement in the longitudinal direction by positioning the shoulder 8*d* in front of the rails 5*h*.

A cavity is formed by the bolt assembly 8 in the longitudinal direction that accommodates a firing pin 9. A rear outer surface 4*e* of the cartridge casing 4 (lying to the right in FIG. 3), lies against a side surface 8*h* of the recess 8*a* of the bolt head 8*b*. When cartridge discharge is desired, the firing pin 9 is moved forward so that its front end emerges from the side surface 8*h* of the recess 8*a* of the bolt head 8*b* to strike and, thus, fire cartridge 3.

As used herein, "centering of the bolt assembly" is understood to mean generally aligning a center axis n of the bolt assembly 8 with the center axis m of the barrel 1 or, preferably, the center axis of the cartridge chamber. Before alignment, the center axis of the bolt assembly 8 is skewed or parallel to (but offset from) the center axis m of the barrel. After alignment, these axes m,n lie roughly, but preferably precisely, coaxially to each other. In the narrower sense, "centering of the bolt assembly" is understood to mean centering of the center axis n of the bolt head 8 of the bolt assembly (or preferably a center axis of the percussion base or, if present, the recess in the bolt head 8 that serves to accommodate the cartridge casing 4) with the center axis of the cartridge chamber.

In the disclosed device, this centering is achieved by a centering element connected to the barrel and not (or only partially) via the seat of the rear end of the casing 4 in the recess in the bolt head 8*b*. Therefore, relatively large tolerances preferably exist between the periphery of the cartridge casing 4 and the percussion base formed in the bolt head 8*b*. During centering of the cartridge 3 during its insertion into the cartridge chamber 2, the bolt assembly 8 is not centered by the cartridges (or is only partially co-centered). Because of this, the cartridge 3 is less severely loaded during the loading process. This is a particular advantage in cartridges with sensitive rounds.

The bolt assembly 8 is also aligned with greater accuracy to the bore of the barrel 1 by the centering process disclosed herein. On this account, after each loading, compatibility conditions are ensured during firing. The disclosed device is, therefore, particularly advantageous in sharpshooter weapons.

The bolt assembly 8 or bolt head 8*b* is centered by the centering element during a forward displacement of the bolt assembly 8. As used herein, "forward displacement" is understood to mean displacement of the bolt assembly 8 in the direction of the cartridge chamber 2 and away from the shooter. When the bolt assembly 8 is being centered, the cartridge 3 is already centered with reference to the barrel 1. As an alternative, the cartridge can be centered by the bolt assembly 8, preferably immediately before or shortly before the cartridge reaches the cartridge chamber. The cartridge is advantageously already in the cartridge chamber during centering of the bolt assembly.

The centering element is directly connected to the barrel 1. The connection between the barrel 1 and centering element is preferably not releasable. By integrated design of the centering element, even greater accuracy during centering of the bolt assembly 8 with reference to the barrel 1 is achieved. Addition of component tolerances is avoided. Because of this, further improved accuracy is achieved. As an alternative, the centering element and the barrel, and/or the centering element and the cartridge chamber can be integrally formed. The accuracy of centering is therefore even further increased.

The centering element advantageously centers the bolt assembly 8 via its bolt head 8*b*. As explained above, the bolt head 8*b* on the front end of the bolt assembly 8 entrains the cartridge casing. If centering of the bolt assembly 8 occurs via the bolt head 8*b*, the bolt head is centered relatively accurately, and, therefore, so is the percussion base recessed in the bolt head 8*b*. Because of this, particularly uniform compatibility conditions during firing are achieved and firing accuracy is increased. Moreover, the functional reliability of the bolt assembly system is improved in the disclosed device.

The centering element is preferably arranged next to the cartridge chamber 2, and the bolt assembly 8 is centered next to the cartridge chamber 2.

The cartridge 3 is centered during centering of the bolt assembly 8 by the centering element. Greater accuracy during introduction of the cartridge 3 into the cartridge chamber 2 is achieved on this account. The inside wall of the cartridge chamber 2 and the outside wall of the cartridge 3, especially the round, are therefore less heavily loaded during loading. Moreover, greater independence is achieved in cartridge geometry. The cartridge 3 need not (or need only partially) center itself by a correspondingly designed outer wall. Preferably, the cartridge 3 is initially roughly pre-centered by the bolt assembly 8, for example, immediately before or shortly after its introduction into the cartridge chamber 2 by engagement of the bolt assembly 8 on the cartridge casing. Fine centering of the cartridge 3 then occurs in the usual manner on contact of the outer wall of the cartridge 3 and inner wall of the cartridge chamber 2.

The bolt assembly 8 is centered by a surface of the centering element lying obliquely with respect to the longitudinal direction of the weapon. The surface is preferably sloped in the direction toward the barrel 1 or cartridge chamber 2. If a front edge of the bolt assembly 8 strikes this surface during forward displacement in the longitudinal direction of the weapon, the bolt assembly 8 is displaced in the transverse direction. Because of this transverse displacement, the center axis of the bolt assembly 8 can be advanced on the bore of the barrel 1. As an alternative, a similar effect can be achieved by a surface of the bolt assembly 8 lying obliquely to the longitudinal direction of the weapon that is sloped in a direction toward the barrel.

Centering of the bolt assembly 8 can occur by the obliquely lying surface of the centering element and by an additional obliquely lying surface of an additional centering element. The two surfaces advantageously lie opposite each other. The additional centering element is preferably directly connected to the barrel and designed integrally. With particular advantage, however, the obliquely lying surface and a second obliquely lying surface, through which the bolt assembly 8 is centered, are provided on the same integral centering element. Because of this, addition of tolerances between different components is prevented. Further increased accuracy during centering of the bolt assembly 8 is therefore achieved.

The centering element has a continuous cavity 6. Centering of the bolt assembly 8 is then advantageously achieved by the fact that a conical inside surface of a first section of the cavity 6 tapers from the rear to the front. As an alternative, an outer surface of the bolt assembly 8 can also taper conically from the rear to the front.

The cavity 6 advantageously has recesses 5*c*, whose inside surfaces 5*e* taper conically from the rear to the front. If the bolt assembly 8 has shoulders 8*d* which are complementary to the recesses 5*c* of the cavity 6, in addition to centering of the bolt assembly 8, rotation of the bolt assembly 8 is simultaneously prevented. The outer surface(s) of the bolt assembly 8, especially the outer surfaces of the shoulders 8*d*, then extend in the horizontal direction. A device in which the outer surfaces of the guide rails formed between two adjacent recesses 5*c* of the cavity 6 taper conically from the rear to the front, is preferred.

After centering of the bolt assembly 8, the bolt assembly is advantageously guided into the centered position with reference to the barrel 1. For this purpose, the centering element preferably has a hollow cylindrical section 5*g*. The inside diameter of the hollow cylindrical section 5*g* is advantageously roughly equal to an outside diameter of the bolt head 8*b*. Because of this, sealing of the cartridge chamber 2 outward is achieved. Soiling of the weapon housing on release of gases during firing is thus reduced. As an alternative, it is conceivable to guide the bolt assembly 8 between at least two guide elements in front of the cartridge chamber 2 in the centered position.

As an alternative, the bolt assembly can have grooves, whose inside surfaces taper conically from the rear to the front. Outer surfaces of rails formed between two grooves of the bolt assembly then also taper conically from the rear to the front. The inside surfaces of the complementary recess of the cavity then preferably extend in the usual manner in the horizontal direction. The outer surfaces of guide rails formed between the two recesses are then also parallel.

The centering element is preferably part of a locking piece and, with particular preference, integrated with it. The locking piece serves to lock the bolt assembly 8 with the barrel 1 after the bolt head 8*b* is introduced into the cartridge chamber 2. Since the locking piece is fastened to the barrel 1, with integral design of the centering element locking piece, a separate fastening for securing the centering element on the barrel 1 can be dispensed with.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. For use in a firearm, an apparatus for loading a cartridge comprising:

a barrel having a center axis;

a cartridge chamber;

a bolt assembly that can be displaced in the longitudinal direction of the weapon from a rearward position to a forward position to advance the cartridge into the cartridge chamber; and a centering element rigidly connected to the barrel for centering the bolt assembly before the cartridge is completely introduced into the cartridge chamber as the bolt assembly moves from the rearward position toward the forward position, wherein a center axis of the bolt assembly is not coaxial with the center axis of the barrel when the bolt assembly is in the rearward position, and the center axis of the bolt assembly is coaxially aligned with the center axis of the barrel after centering by the centering element, and wherein the centering element comprises a rearward cavity including recesses with outer surfaces which taper conically from a rear of the rearward cavity to a front of the rearward cavity, and the centering element further includes a cylindrical forward cavity, the cylindrical forward cavity having an inner diameter dimensioned to receive at least part of the bolt assembly to complete advancement of the cartridge into the cartridge chamber.

2. An apparatus as defined in claim 1, wherein guide rails are located between adjacent ones of the recesses of the centering element, and wherein outer surfaces of the guide rails taper conically from the rear of the rearward cavity to the front of the rearward cavity.

3. An apparatus as defined in claim 1, wherein the cylindrical forward cavity is positioned to guide the bolt assembly into the forward position.

4. An apparatus as defined in claim 1, wherein the bolt assembly includes grooves having inside surfaces which taper conically from rear to front.

5. An apparatus as defined in claim 4, wherein rails are located between adjacent ones of the grooves of the bolt assembly, and the rails taper conically from rear to front.

6. An apparatus as defined in claim 1, wherein the centering element comprises part of a locking piece.

7. An apparatus as defined in claim 1, wherein the centering element is integrally formed with the barrel.

8. An apparatus as defined in claim 1, wherein the bolt assembly includes a bolt head, and the centering element centers the bolt assembly by interacting with the bolt head.

9. An apparatus as defined in claim 1, wherein the centering element is located adjacent the cartridge chamber.

10. An apparatus as defined in claim 3, wherein an inside diameter of the cylindrical forward cavity is substantially equal to an outside diameter of a bolt head of the bolt assembly.

11. An apparatus as defined in claim 1, wherein an outside surface of the bolt assembly tapers conically from rear to front.

12. An apparatus as defined in claim 1, wherein centering the cartridge does not center the bolt assembly.

13. For use with a cartridge having a center axis, a firearm comprising:

a barrel having a center axis;

a cartridge chamber;

a bolt assembly mounted for movement from a rear position to a forward position to advance a cartridge into the cartridge chamber, the bolt assembly including a center axis which is not in coaxial alignment with the center axis of the barrel when the bolt assembly is in the rear position, the bolt assembly further including a bolt head defining a percussion recess, the percussion recess being dimensioned to receive a proximal end of the cartridge with clearance to permit transverse movement of the proximal end of the cartridge relative to the percussion base; and a locking piece adjacent the cartridge chamber for centering the bolt head as the bolt assembly moves from the rear position toward the forward position such that the center axis of the bolt assembly is substantially coaxially aligned with the center axis of the barrel, wherein the center axis of the cartridge is not in coaxial alignment with the center axis of the barrel when the bolt head engages the cartridge, and the center axis of the cartridge becomes substantially coaxially aligned with the center axis of the barrel after engagement of the bolt head and the cartridge but before the center axis of the bolt assembly becomes substantially coaxially aligned with the center axis of the barrel.

* * * * *